United States Patent [19]

Anderson

[11] 4,358,241

[45] Nov. 9, 1982

[54] BUCKET ASSEMBLY FOR TRACTORS

[75] Inventor: Carl M. Anderson, Claremore, Okla.

[73] Assignee: Hesston Corporation, Hesston, Kans.

[21] Appl. No.: 175,340

[22] Filed: Aug. 4, 1980

[51] Int. Cl.[3] ..... E02F 5/00

[52] U.S. Cl. ..... 414/703

[58] Field of Search ..... 414/703, 714, 715, 716, 414/717; 37/117.5; 172/266, 268, 445, 449, 458, 467, 494, 605, 272, 275, 499, 506, 749, 750

[56] References Cited

U.S. PATENT DOCUMENTS

| | | | |
|---|---|---|---|
| 1,856,148 | 5/1932 | Ball | 37/117.5 |
| 2,254,292 | 2/1941 | Jones | 414/703 X |
| 2,364,121 | 12/1944 | Arps | 414/703 |
| 2,423,894 | 7/1947 | Lambert | 414/703 |
| 3,187,912 | 6/1965 | McKnight | 414/703 |
| 3,368,706 | 2/1968 | Vaalimaa et al. | 414/703 |
| 3,662,839 | 5/1972 | Thorsrud et al. | 172/266 |
| 4,084,853 | 4/1978 | Keenan | 414/703 X |

*Primary Examiner*—Douglas C. Butler

*Attorney, Agent, or Firm*—Schmidt, Johnson, Hovey & Williams

[57] ABSTRACT

A multi-purpose rear attachment for power lifts and drawbars of tractors has a bucket for handling bulk materials which is self-filling when used as a scoop and the capability of use as a scraper, a spreader and a leveler of the materials it transports. Linkage connected to the drawbar tilts the bucket as it is raised by the lift to a position retaining its contents, the linkage itself being variable to control the range of tilt. A trip accessible to the tractor operator releases one of the links such that the bucket becomes self-dumping. Camming actions by the trip effect positive release and relatching.

14 Claims, 10 Drawing Figures

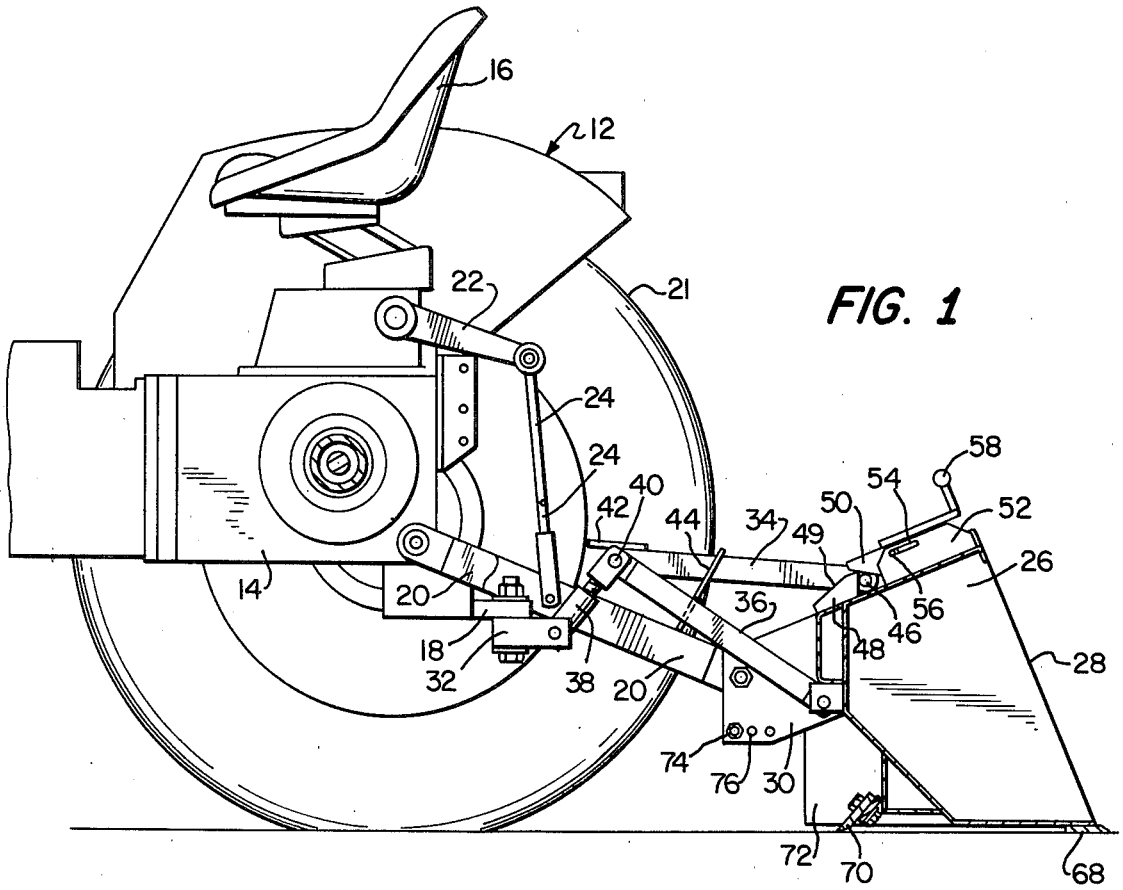
FIG. 1
FIG. 2
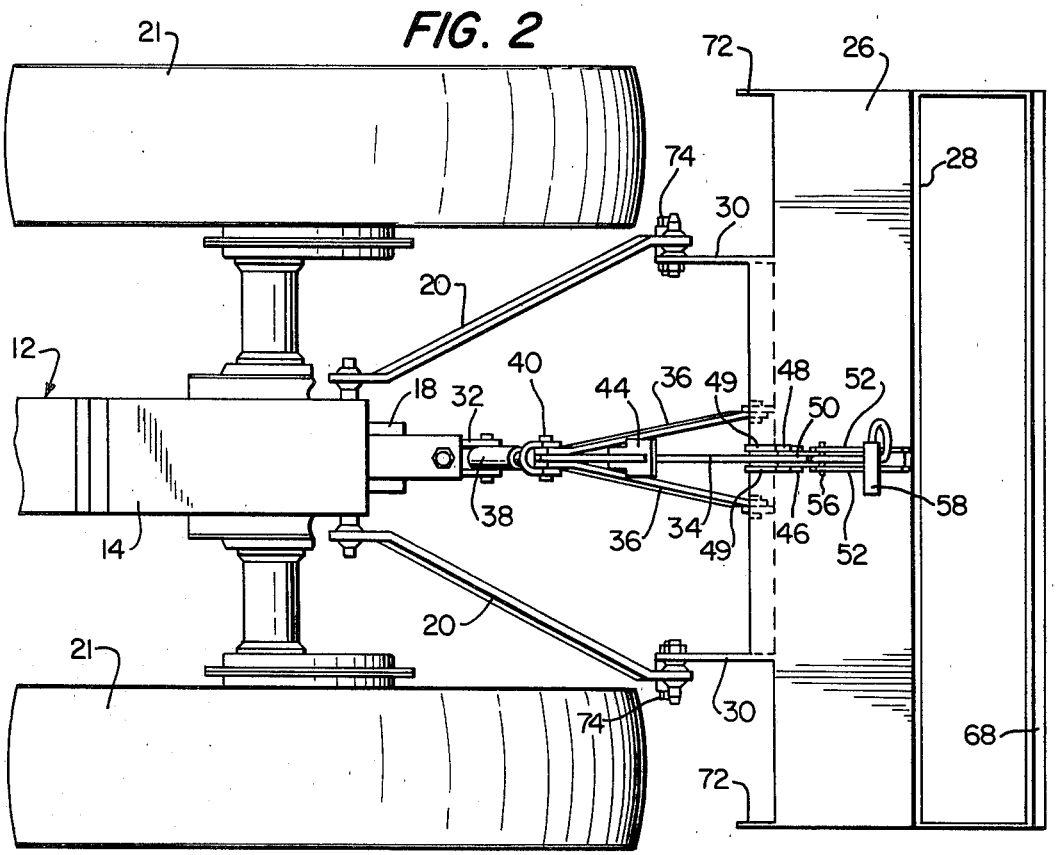

BUCKET ASSEMBLY FOR TRACTORS

While tractor-supported buckets, scoops, excavators, loaders, shovels, dredges and the like are commonplace for major operations, there is a need for a lightweight, inexpensive, small tractor attachment to handle relatively minor amounts of bulk materials such as soil, sand and rock fragments, not only on farms but for construction and maintenance of recreational areas, lawns and gardens, streets, public utilities and the like.

Accordingly, there is provided in the instant invention a bucket that may be quickly and easily attached for pivotal movement on the rear power lift available as original equipment on virtually all small tractors. Added to the bucket is specially constructed linkage releasably connected to the tractor drawbar for automatically tilting the bucket in response to its up and down swinging movement.

The linkage has a simple, easily adjusted control link for varying the amount of tilt of the bucket, and still another link that is releasable for dumping purposes. The tripping latch for the releasable link can be reached by the operator on the tractor seat after the filled bucket is raised and the materials transported to an area where they are to be discharged.

The control link and the releasable link are jointed together end-to-end, but not in line when the bucket is lowered. As force is applied to the knee, which tends to straighten the arrangement, as in a toggle joint, the two links undergo endwise pressure which increases as the links approach their straight-line position.

In the drawings

FIG. 1 is a side elevational view, partially in section of a lowered bucket assembly for tractors made according to the present invention, attached to a tractor shown fragmentarily;

FIG. 2 is a plan view of the arrangement illustrated in FIG. 1, but with certain tractor parts eliminated for clearness;

Figure 3:
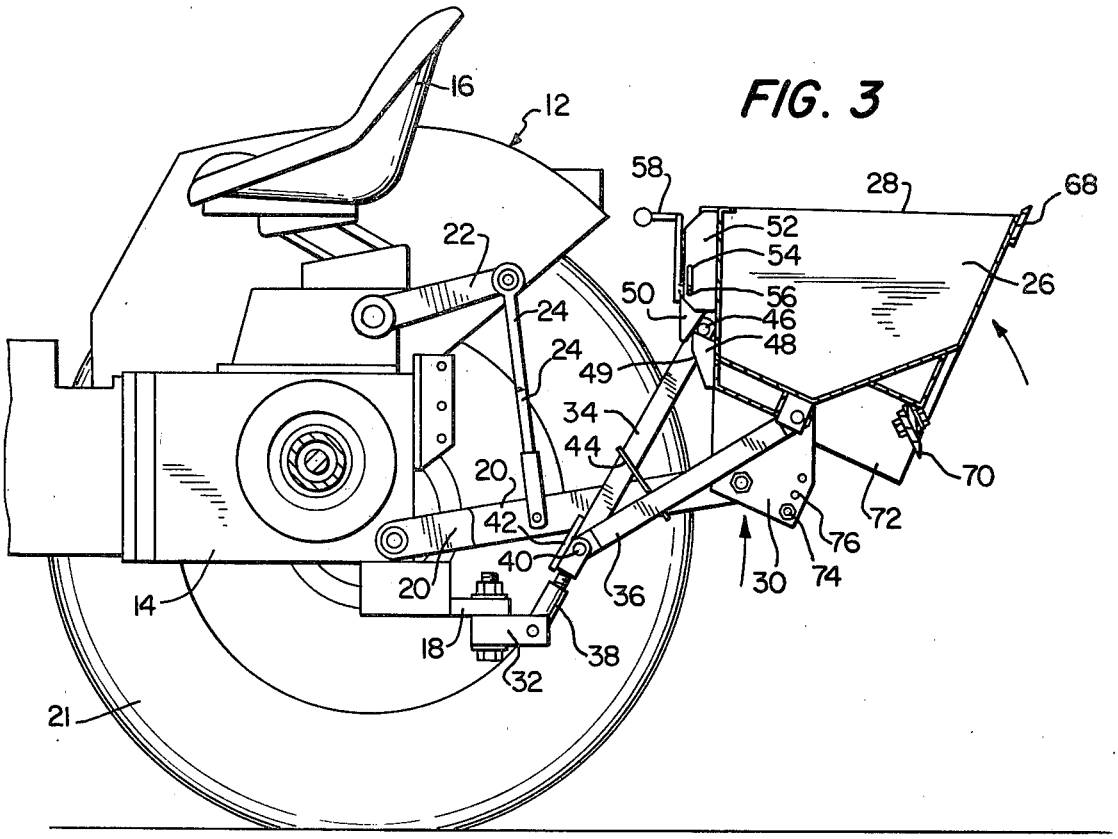
FIG. 3 is a view similar to FIG. 1 showing the bucket raised.

A tractor 12, provided with a chassis 14, an operator's seat 16 and a rearwardly extending drawbar 18 on the chassis 14, has a power lift which includes a pair of rearwardly extending arms 20 swingably carried by the chassis 14 between rear wheels 21. A pair of powered cranks 22 vertically swingable on the tractor 12, raise and lower the arms 20 through corresponding extensible connectors 24 depending from the cranks 22.

A bucket 26, having the bowl thereof provided with an inlet mouth 28, is provided with brackets 30 pivotally connected to the rear ends of the arms 20, and linkage is provided between the bucket 26 and a clevis 32 bolted to the drawbar 18 for tilting the bucket 26 relative to the arms 20 as the bucket 26 is raised and lowered by the lift.

The linkage includes an upper link 34 and a pair of lower links 36, all pivotally connected to the bucket 26, and a fourth link 38 pivotally connected to the clevis 32 and to the links 34 and 36 by a common pivot 40, the link 38 being extensible. A stop 42 is rigidly connected to the link 34, overlapping the knee joint of the toggle presented between the links 34 and 38 by the pivot 40. A second stop 44, also rigid to the link 34, is engageable with the links 36.

The link 34 has a cross pin 46 normally looped over a pair of spaced hooks 48 on the bucket 26 having cam edges 49, the pin 46 being held in place by a pair of interconnected triangular lugs presenting a latch 50. A pair of spaced plates 52 on the bucket 26, which receive the latch 50 therebetween, have slots 54 within which rides a slide pin 56 rigid to the latch 50. A handle 58 and a retainer pin 60 are provided on the latch 50, the pin 60 receiving one end of a flexible hose 62. A spring 64, coiled about the hose 62 is interposed between the latch 50 and an abutment 66 on the bucket 26.

The bucket 26 has a pair of spaced blades 68 and 70, the blade 68 extending along the mouth 28 and the blade 70 extending between a pair of wings 72 on the bucket 26. Stops 74, selectively mounted in any one of a number of holes 76 in the brackets 30, are engageable with corresponding arms 20.

OPERATION

When the bucket 26 is in its lowered position shown in FIGS. 1 and 2, it is but necessary to back the tractor 12 to force the digging blade 68 into a pile or bank of dirt, sand, rock fragments or other materials to fill the bowl of the bucket 26 through the mouth 28. By actuation of hydraulic valving adjacent the seat 16, the operator causes raising of the cranks 22 to lift the arms 20 through the connectors 24.

This raises the loaded bucket 26 to the position shown in FIG. 3 causing, by virtue of the geometry of the linkage 34, 36 and 38, upward tilting of the bucket 26 about its pivotal connection with the arms 20 until the mouth 28 opens upwardly such that the contents of the bucket 26 are retained during transport by the tractor 12.

While the angularity between the links 34 and 36 does not change during the raising of the bucket 26, the change in the angle between the links 34 and 38 effects the tilting of the bucket 26. When force is applied to the knee at the pivot 40, tending to straighten the arrangement between the links 34 and 38, an endwise pressure will occur at the proximal ends of the links 34 and 38 acting on the pivot 40, such pressure progressively increasing until the links 34 and 38 arrive at their straight-line position shown in FIG. 3. The stop 42 will move into engagement with the link 38 across the toggle joint to preclude overcenter buckling of the links 34 and 38 as is shown in FIG. 3.

The handle 58 will have moved to a position accessible to the operator on the seat 16 for manual actuation after the materials have been transported to the area where they are to be dumped. He need pull upwardly on the handle 58 to raise the latch 50 against the action of the spring 64 until the latch 50, guided by the pin 56 in slots 54, clears the pin 46.

Figure 8:
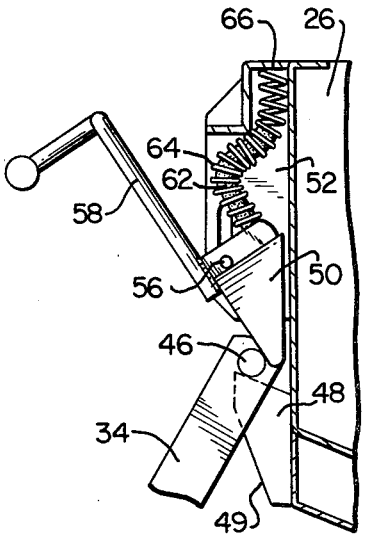
FIG. 8 is a view similar to FIG. 7 showing the unlatching operation.
Figure 10:
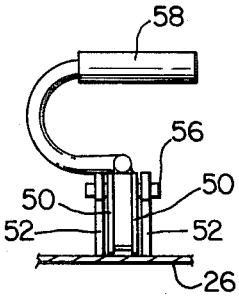
FIG. 10 is a detailed cross sectional view taken on line 10—10 of FIG. 6.
Figure 9:
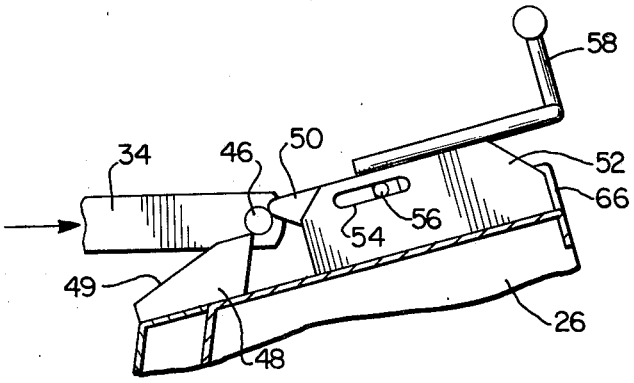
FIG. 9 is an enlarged, fragmentary view of the latch, similar to FIG. 5.

By virtue of the flexibility of the spring 64 and the hose 62 and the rotatability of the pin 56 in the slots 54, the handle 58 may then be pulled toward the seat 16 to position the latch 50 into wedging relation to the pin 46 as shown in FIG. 8. As the latch 50 is shifted downwardly, the pin 46 is forced off the upper, inclined ledges of the hooks 48, thereby releasing the bucket 26 for downward dumping about its pivotal connection with the links 36.

Figure 4:
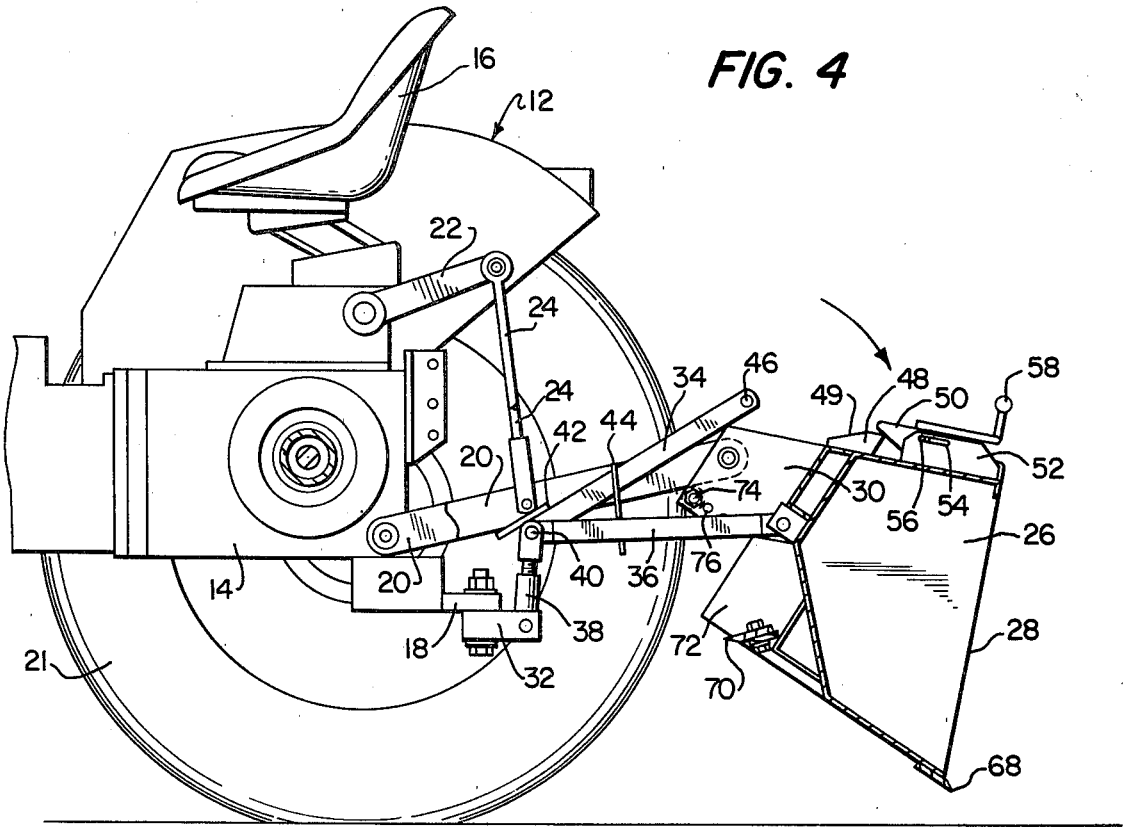
FIG. 4 is a view similar to FIG. 1 showing the dumped position of the bucket.

As seen in FIG. 4, the extent of swinging of the bucket 26 away from the pin 46 is limited by the engagement of the stops 74 with the arms 20, and the extent of gravitation of the link 34 about the pivot 40 is limited by engagement of the stop 44 with the links 36. The bucket 26 is now sloped such that its contents will readily flow therefrom through the mouth 28.

Figure 5:
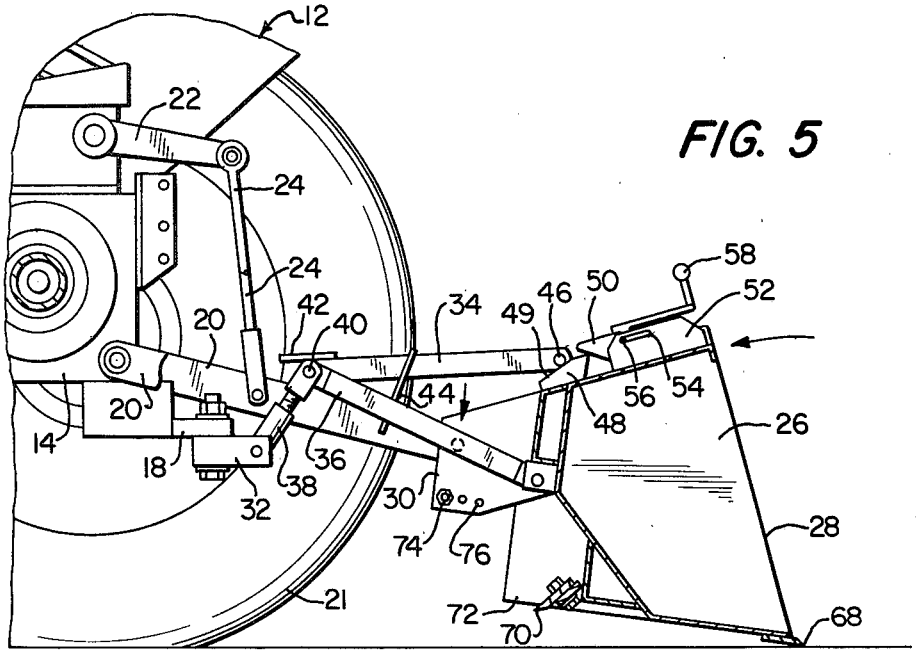
FIG. 5 is a view similar to FIG. 1 showing the relatching operation.
Figure 6:
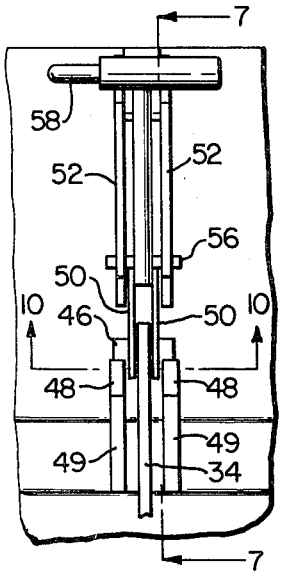
FIG. 6 is an enlarged, fragmentary, elevational view of the latch.
Figure 7:
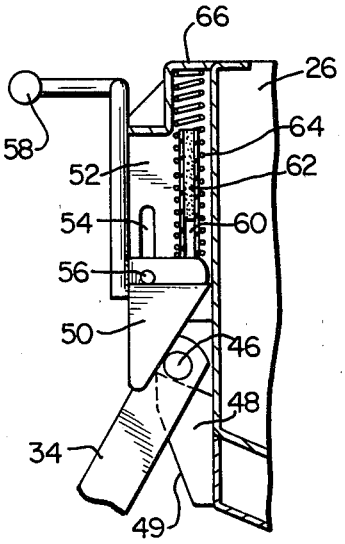
FIG. 7 is a fragmentary cross sectional view taken on line 7—7 of FIG. 6.

Upon lowering of the bucket 26 to the position shown in FIG. 5, the pin 46 is held in proper position to engage the hooks 48 whose cam edges 49 force the pin 46 against the latch 50 thereby camming the latter open against the action of the spring 64 such that the pin 46 snaps into place over the hooks 48 and the spring 64 snaps the latch 50 closed. The blade 70 may then be used to spread and level the materials thus discharged from the bucket 26, aided by the materials confining action of the wings 72. Manifestly, however, the blades 68 and 70 are available for use in many other scraping and materials displacement operations as desired.

The extent to which the cranks 22 raise and lower the arms 20 during the full strokes of the cranks 22 can be varied by extending or shortening the connectors 24. Also, the extent to which the bucket 26 is tilted between its lowermost and uppermost position during actuation of the arms 22, as the result of straightening and buckling of the links 34 and 38 may be varied by extending or shortening the link 38.

I claim:

1. In combination with a tractor having a chassis provided with a power lift and a drawbar, an attachment for transporting, scraping, spreading and leveling bulk materials, said attachment including:

a bucket provided with a bowl having a materials inlet mouth;

pivot means tiltably mounting the bucket on said lift, said bucket being normally disposed when in a lowered condition for receiving materials scooped thereby into its bowl through said mouth;

linkage pivotally interconnecting the bucket and said drawbar for tilting the bucket upwardly to a materials retentive position in response to raising of the bucket by said lift; and a manually manipulable linkage disconnect assembly for releasing the bucket for automatic downward tilting thereof to a position dumping the materials from said bowl;

said linkage including upper and lower link means pivotally connected to the bucket, and a control link pivotally connected to the drawbar and to said upper and lower link means.

2. The invention of claim 1, said control link being extensible for varying the range of tilting of the bucket during raising and lowering thereof by said lift, there being a pivot common to the control link and to the upper and lower link means.

3. The invention of claim 1, said upper link means including a single link angularly offset with respect to the control link when the bucket is in said lowered condition, said control link controlling said linkage for movement of the single link and the control link into end-to-end relationship when the bucket is raised by the lift to a position adjacent the uppermost end of its path of travel.

4. The invention of claim 3; and stop means disposed for engagement with said single link and the control link when the bucket is raised to said uppermost end of its path of travel for precluding over center displacement of the control link and said single link beyond said end-to-end relationship.

5. The invention of claim 1, said control link having a releasable pivotal connection with the bucket, said assembly having means for releasing said pivotal connection.

6. The invention of claim 5, said pivotal connection including a pin secured to the retention link, and means releasably latching the pin to the bucket.

7. The invention of claim 6, said pivotal connection including pin-engaging lug means on the bucket and a spring-loaded latch for holding the pin in engagement with the lug means.

8. The invention of claim 1; and a digger blade on the bucket along said mouth for loosening said materials while the latter are being scooped into the bowl.

9. The invention of claim 8; and a spreader blade on the bucket in opposed relation to the digger blade for leveling materials dumped from the bowl.

10. A bucket assembly for tractors having a power lift, said assembly comprising:

a materials handling bucket;

means for pivotally attaching the bucket to said lift;

linkage pivotally connected with the bucket, said linkage including a pair of links pivotally interconnected in end-to-end relationship out of alignment when the bucket is lowered, presenting a toggle link having a knee joint at the zone of link interconnection; and means for pivotally attaching one of said pair of links to the tractor whereby the pair of links swing to a straight line position and tilt the bucket upwardly relative to the lift as the bucket is raised by the lift, the other of said pair of links having a releasable pivotal connection with the bucket for dumping of the bucket when said other links are released.

11. The invention of claim 10, said linkage having means for limiting the extent of downward swinging movement of said other link at said joint after release of the other link.

12. The invention of claim 10, said releasable connection including a manually manipulable latch normally locking said other link to the bucket.

13. The invention of claim 12, said latch having cam means for unlocking said other link.

14. The invention of claim 12; and means on the bucket for camming said other link into locked relationship to the bucket.

* * * * *